US008701782B2

(12) United States Patent
Bane et al.

(10) Patent No.: US 8,701,782 B2
(45) Date of Patent: Apr. 22, 2014

(54) SUBSURFACE SAFETY VALVE WITH METAL SEAL

(75) Inventors: Darren E. Bane, Broken Arrow, OK (US); David Z. Anderson, Glenpool, OK (US)

(73) Assignee: Baker Hughes Incorporated, Houston, TX (US)

( * ) Notice: Subject to any disclaimer, the term of this patent is extended or adjusted under 35 U.S.C. 154(b) by 689 days.

(21) Appl. No.: 11/691,324

(22) Filed: Mar. 26, 2007

(65) Prior Publication Data

US 2008/0237993 A1 Oct. 2, 2008

(51) Int. Cl.
*E21B 34/10* (2006.01)

(52) U.S. Cl.
USPC ..... 166/375; 166/319; 166/332.8; 277/644; 277/616

(58) Field of Classification Search
USPC ..... 166/375, 319, 332.8
See application file for complete search history.

(56) References Cited

U.S. PATENT DOCUMENTS

| | | | | |
|---|---|---|---|---|
| 3,649,032 | A * | 3/1972 | Nelson | 277/322 |
| 3,784,214 | A * | 1/1974 | Tamplen | 277/341 |
| 4,252,197 | A | 2/1981 | Pringle | |
| 4,448,254 | A | 5/1984 | Barrington | |
| 4,467,870 | A * | 8/1984 | Langham | 166/321 |
| 4,660,646 | A | 4/1987 | Blizzard | |
| 4,676,307 | A | 6/1987 | Pringle | |
| 4,716,969 | A * | 1/1988 | Pringle | 166/321 |
| 4,813,692 | A * | 3/1989 | Halling et al. | 277/626 |
| 5,310,004 | A | 5/1994 | Leismer | |
| 5,564,501 | A | 10/1996 | Strattan et al. | |
| 6,109,351 | A | 8/2000 | Beall | |
| 6,299,178 | B1 * | 10/2001 | Halling | 277/654 |
| 6,446,978 | B1 * | 9/2002 | Halling et al. | 277/626 |
| 6,637,750 | B2 * | 10/2003 | Quoiani | 277/339 |
| 6,866,101 | B2 | 3/2005 | Sloan | |
| 6,896,049 | B2 | 5/2005 | Moyes | |
| 7,510,019 | B2 * | 3/2009 | Li et al. | 166/387 |
| 2002/0074742 | A1 | 6/2002 | Quoiani | |
| 2005/0087335 | A1 * | 4/2005 | Vick | 166/66.5 |
| 2008/0217020 | A1 * | 9/2008 | Haynes | 166/332.8 |

OTHER PUBLICATIONS

International Search Report with Written Opinion, PCT/US2008/058152, Date mailed Oct. 31, 2008. Search report having 6 pages, Written Opinion have 8 pages.

Adams, Jeff K., et al. "Methodology for Optimum Deepwater Safety System Selection," AADE 01-NC-HO-07, 2001 National Drilling Conference, Houston, TX Mar. 27-29, 2001.

Camco Subsurface Safety Valves, "Fail-safe Protection for Oil and Gas Wells," Schlumberger: www.connect.slb.com: SMP-5778, Apr. 2001.

Garner, James, et al. "At the Ready: Subsurface Safety Valves," Oilfield review: Winter 2002. pp. 52-54.

Jennings, Steven L. "Choke or Inline Valve," U.S. Appl. No. 11/724,527, filed Mar. 15, 2007. Specification having 9 pages, Figures having 2 sheets.

* cited by examiner

*Primary Examiner* — Jennifer H Gay
*Assistant Examiner* — Elizabeth Gitlin
(74) *Attorney, Agent, or Firm* — Cantor Colburn LLP

(57) ABSTRACT

A biased actuator includes, a reservoir, at least one piston in operable communication with the reservoir, at least one metal seal and a biasing system in operable communication with both the reservoir and the at least one piston. The at least one metal seal is disposed about the at least one piston and is sealed to both the piston and the reservoir.

6 Claims, 8 Drawing Sheets

SUBSURFACE SAFETY VALVE WITH METAL SEAL

BACKGROUND OF THE INVENTION

Subsurface safety valves SSVs are safety devices mounted deep within wells to control flow to the surface. They generally have many components in common. The valve member is generally a flapper, which rotates 90° and is held open by a flow tube shiftable downwardly therethrough to cause the 90° rotation. This direction of movement (opening) is away from a closure or seat. A control system is generally employed to urge the flow tube in the opening direction involving hydraulic pressure from the surface connected to the SSV below via a hydraulic control line. In general, applied pressure opens the valve, while removal of applied pressure from the surface allows a power spring acting on the flow tube to move the flow tube in a direction opposite the opening direction and thereby out of the path of the flapper. This allows the flapper to pivot 90° to a closed position.

Various types of control systems have been employed for SSVs in order to address various different issues or interests of an operator. To reduce the size of the closure spring acting on the flow tube, reservoirs pressurized with a gas have been used to counteract the hydrostatic pressure from the column of hydraulic fluid in the control line that runs from the surface down to the SSV. Since the pressurized gas resists the hydrostatic force and offsets it, closure of the SSV is accomplished with a fairly small spring when the actuating piston, acting on the flow tube, is placed in hydraulic pressure balance, thus allowing the small closure spring to shift the flow tube and allow the flapper of the SSV to close.

Such systems include pressurized reservoirs having a gas on one side and hydraulic fluid (liquid) acting on the opposite side of an actuating piston. In order to make such systems work, numerous seals are used. Control systems have also been developed that serve to allow normal opening and closing of the SSV while, at the same time, restricting the valve to fail in a predesignated safe position in the event of an occurrence of any of a number of different possible conditions or events relating to component failures in the control system. U.S. Pat. No. 6,109,351 (hereinafter "'351" and which is incorporated herein by reference in its entirety), for example, describes such a control system.

With the large number of seals in such a system and the requirement that many of the seals must maintain a seal while statically engaging with a piston and slidably engaging with a cylinder bore; seals are a major source of such component failure. Though the failsafe control system prevents undesirable uphole flow when a seal failure does occur it remains a costly undertaking to withdraw the SSV from downhole to repair and/or replace the defective seal or seals and run the SSV downhole again. As such, the art will welcome seals that exhibit improved durability and reliability.

BRIEF DESCRIPTION OF THE INVENTION

Disclosed herein is a biased actuator. The actuator includes, a reservoir, at least one piston in operable communication with the reservoir, at least one metal seal disposed about the at least one piston and in substantial sealing communication therewith, the at least one metal seal further being in substantial sealing communication with the reservoir and a biasing system in operable communication with both the reservoir and the at least one piston.

Further disclosed herein is a control arrangement for a downhole valve. The control arrangement includes, at least one valve actuating piston having at least one metal seal sealingly engaging a housing in which the at least one valve actuating piston is movable, the at least one valve actuating piston having an opening force and a closing force, the opening force is connectable to a selectively controllable pressure source, a primary biasing arrangement acting on the closing force and a secondary biasing arrangement in selective operable communication with the closing force.

BRIEF DESCRIPTION OF THE DRAWINGS

The following descriptions should not be considered limiting in any way. With reference to the accompanying drawings, like elements are numbered alike.

DETAILED DESCRIPTION OF THE INVENTION

A detailed description of an embodiment of the disclosed apparatus and method are presented herein by way of exemplification and not limitation with reference to the Figures.

The control system disclosed in '351 has two pistons and two gas charged reservoirs or chambers. One of the pistons is an actuating piston and the other is a balancing piston. Both pistons may be made of metal. The actuating piston moves a flow tube in a downhole direction in response to a pressure increase supplied from surface via a control line. The flow tube is moved in an uphole direction in response to urging from a power spring when the pressure in the control line is reduced below a predetermined value. The other piston is a pressure-balancing piston that isolates a primary gas charged pressure from the control line when all seals are properly sealing. The pressure-balancing piston allows the pressure of the primary gas charge to bleed to the control line and thereby equalize with the control line pressure in response to leakage of any of a plurality of control system seals. Each of the pistons in the control system has at least one seal that sealably engages with the piston and slidably sealably engages with cylinders in which the pistons are axially moveable. Disclosed herein is an exemplary embodiment of a subsurface safety valve with metallic seals employing the control system of '351.

Figure 1:
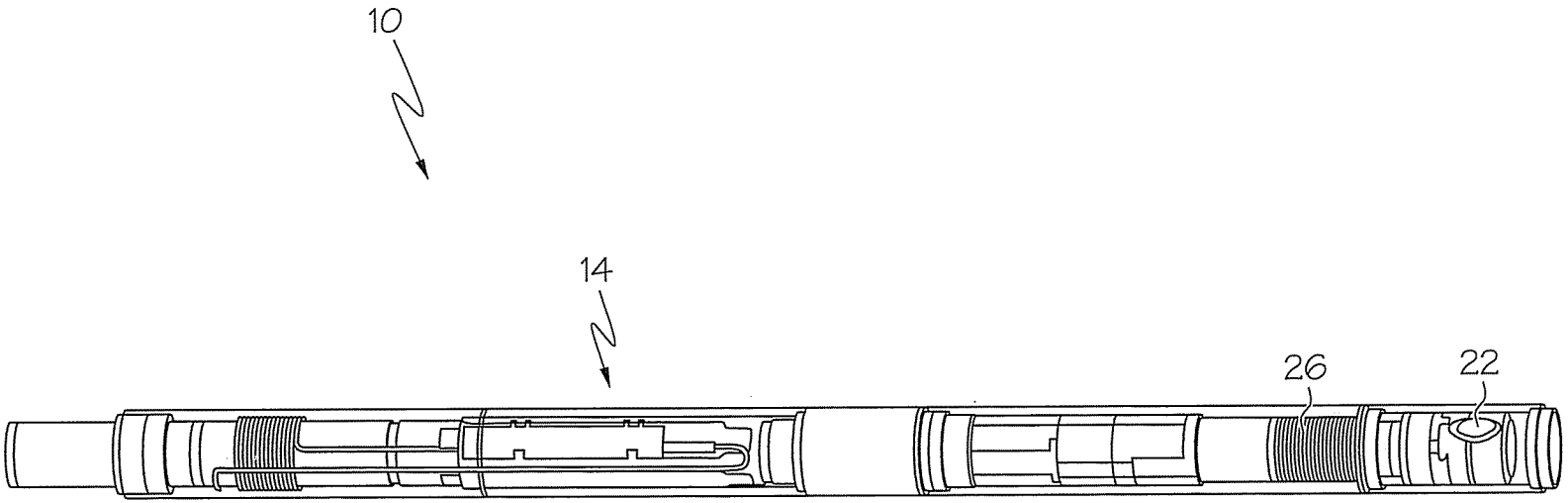
FIG. 1 depicts a subsurface safety valve disclosed herein.
Figure 2:
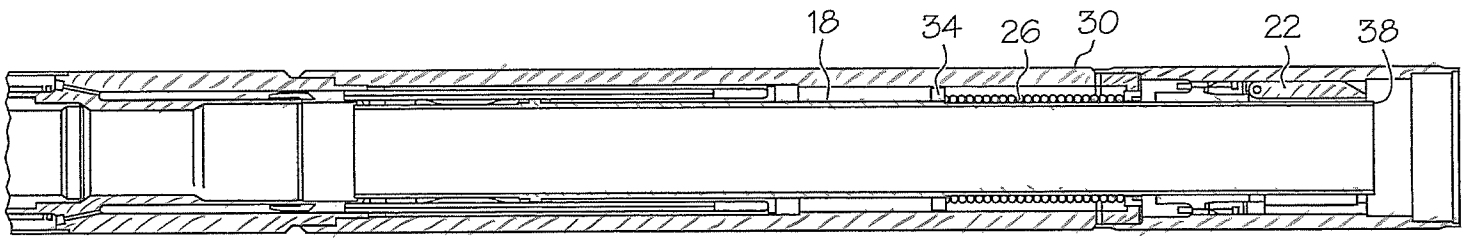
FIG. 2 depicts a portion of the subsurface safety valve of FIG. 1 at a higher magnification.
Figure 3:
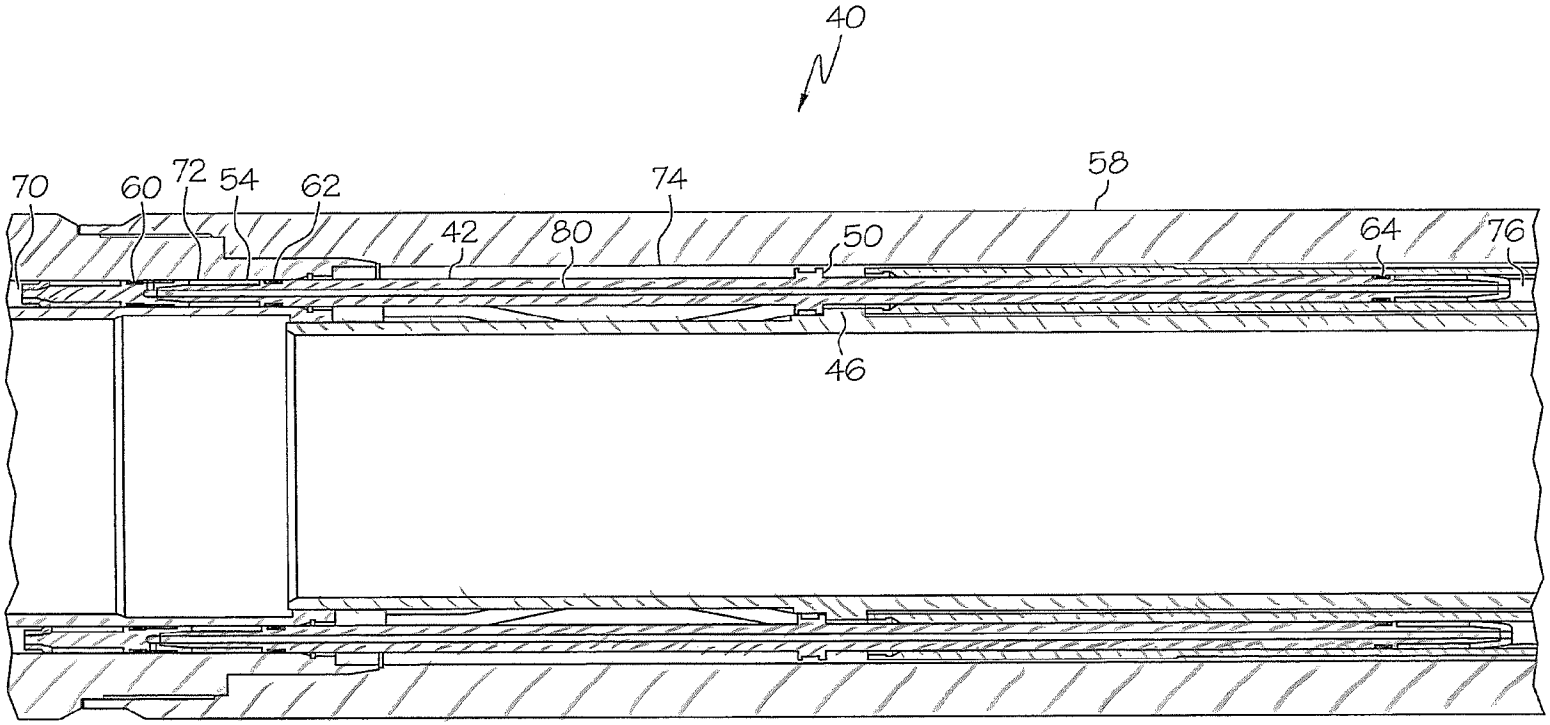
FIG. 3 depicts an actuator used in the subsurface safety valve of FIG. 1.
Figure 4:
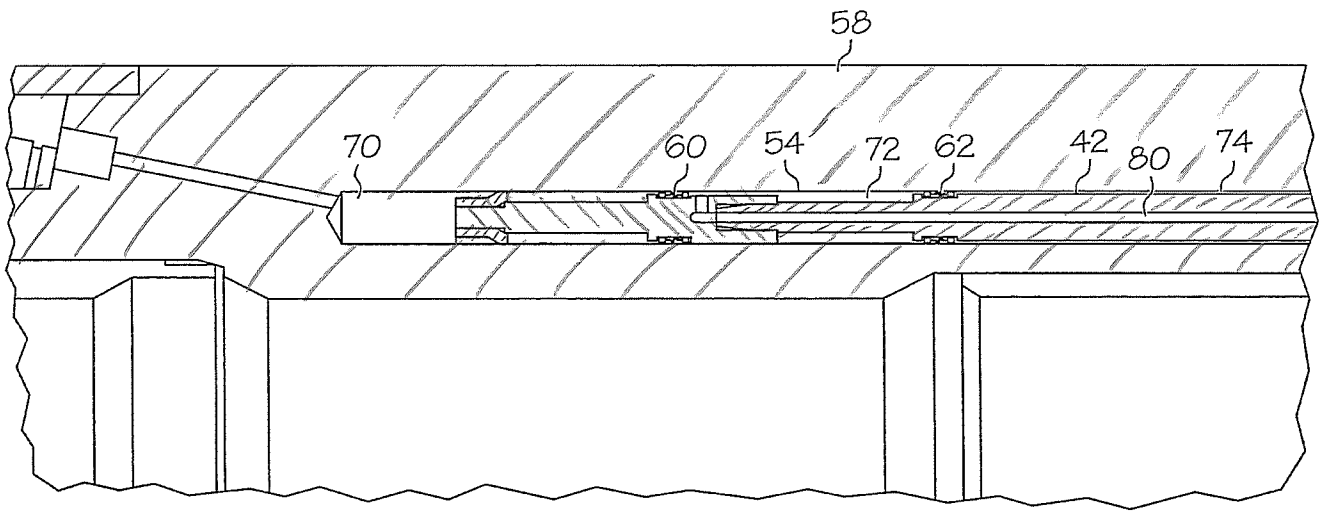
FIG. 4 depicts a portion of the actuator of FIG. 3 shown at a higher magnification.
Figure 5:
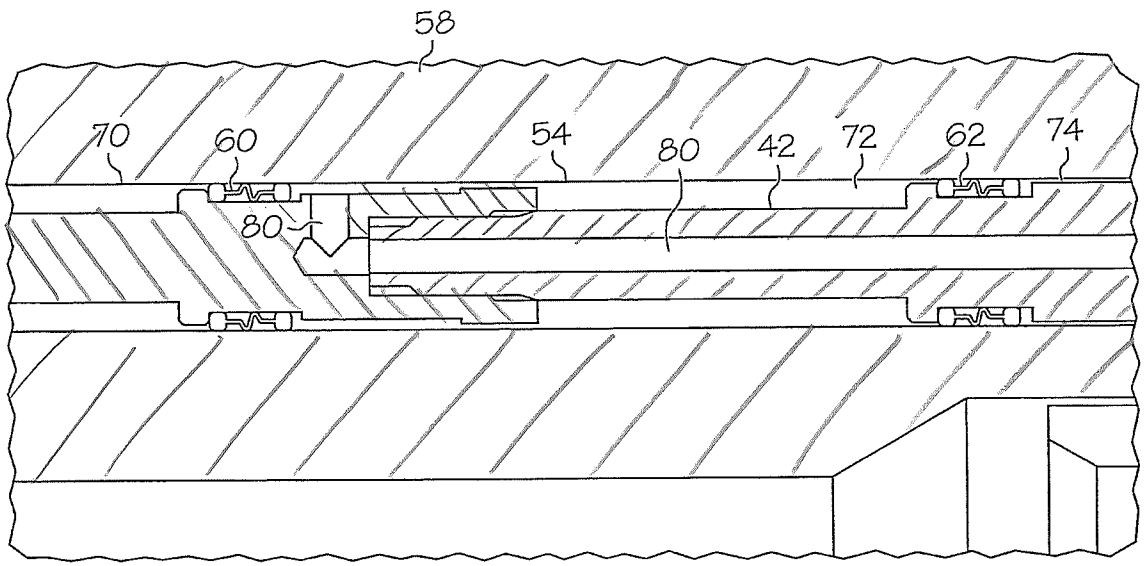
FIG. 5 depicts an even higher magnification of a portion of the actuator of FIG. 3.

Referring to FIGS. 1 and 2 an embodiment of the subsurface safety valve 10 is illustrated. The safety valve 10 among other things includes a control arrangement 14, a flow tube 18, a flapper 22 and a power spring 26. The control arrangement 14 includes pistons, seals and gas charged reservoirs or chambers that are too small to be seen in FIGS. 1 and 2 and will be described with reference to FIGS. 2 through 8 below. In FIGS. 1 and 2 the safety valve 10 is shown in an open position thereby allowing fluid to flow through the safety valve 10 in either an uphole or a downhole direction. The flow tube 18 is repositionable between an uphole and a downhole position (shown in downhole position). When the flow tube 18 is in the downhole position the flow tube 18 locks the flapper 22 between the flow tube 18 and a housing 30 in an orientation substantially parallel to an axis of the flow tube 18, thereby holding the safety valve 10 open. The power spring 26 is positioned between the housing 30 and a shoulder 34 of the flow tube 18 such that it presents a biasing force to urge the flow tube 18 in the uphole direction toward the closed valve position. When the safety valve 10 is in the closed position (not shown), the flapper 22 is pivoted 90° such that the flapper 22 is substantially perpendicular to the axis of the flow tube 18 and seals against a seat 38. An optional biasing member (not shown), such as a torsion spring, for example, can be mounted about a hinge of the flapper 22 to urge the flapper 22 toward the closed position. With the valve 10 in the closed position fluid is prevented from flowing through the safety valve 10 in either the uphole or downhole direction. It should be noted however that in instances when there is a greater pressure on an uphole side of the flapper 22 than a downhole side of the flapper 22 the pressure differential may be able to urge the flapper 22 off the seat 38 allowing flow in a downhole direction even while the flow tube 18 is in the uphole position. In contrast when pressure on the uphole side of the flapper 22 is less than on a downhole side of the flapper 22 the difference in pressures urges the flapper 22 against the seat 38 thereby increasing the sealing engagement force of the flapper 22 against the seat 38.

Through the foregoing structure the movement of the flow tube 18 between the uphole position and the downhole position facilitates the operation of the safety valve 10 between an open and closed position. As such, by controlling the position of the flow tube 18 the opening and closing of the safety valve 10 can be controlled.

Referring to FIGS. 2-5 one embodiment of an actuator 40 of the Control arrangement 14 including a pair of actuating pistons 42 is illustrated. Although two actuating pistons 42 are disclosed alternate embodiments could have more than two actuating pistons 42 or a single actuating piston 42. Each of the actuating pistons 42 is functionally engaged with the flow tube 18. In this embodiment the functional engagement includes a shoulder 50 on each actuating piston 42 that is contactable with a shoulder 46 on the flow tube 18 such that movement of the actuating pistons 42 in a downhole direction causes a corresponding movement of the flow tube 18 in a downhole direction. The biasing force of the power spring 26 on the flow tube 18, in an uphole direction, assures that the opposing shoulders 46 and 50 remain in continuous contact. The actuating pistons 42, in this embodiment, are each housed within a longitudinal cylinder 54 formed in a housing 58, which may be made of metal, and are sealably engaged with the cylinder 54 by a plurality of seals 60, 62, and 64. Each of the seals 60, 62, 64 sealably engages with the piston 42 and the cylinder 54 to which they are engaged. The engagement of the seals 60, 62, 64 with the cylinders 54 is also slidable such that the piston 42 and the seals 60, 62, 64 can move axially within the cylinder 54 while maintaining a seal with the cylinder 54. While each of the sealing locations of this embodiment incorporates a single metal seal 60, 62, 64 it should be understood that alternate embodiments could use multiple metal seals 60, 62 and 64 at each sealing location.

The seals 60, 62, 64 divide the cylinder 54 into four cavities 70, 72, 74, and 76. The seal 60 isolates the cavity 70 from the cavity 72, the seal 62 isolates the cavity 72 from the cavity 74, and the seal 64 isolates the cavity 74 from the cavity 76. The cavity 74 is fluidically connected, via a port not shown, to a downhole environment within which the safety valve 10 is located. Similarly, the cavity 70 is fluidically connected to a control line through a port not shown that ports control pressure from the surface to the safety valve 10. A longitudinal port 80 within each of the actuating pistons 42 fluidically connects the cavities 72 and 76 such that the cavities 72 and 76 are maintained at equal pressures at all times. Additionally, the cavity 76 is ported to a primary charge pressure via a portion of the control arrangement 14 that will be described with reference to FIGS. 6 and 7.

Figure 6:
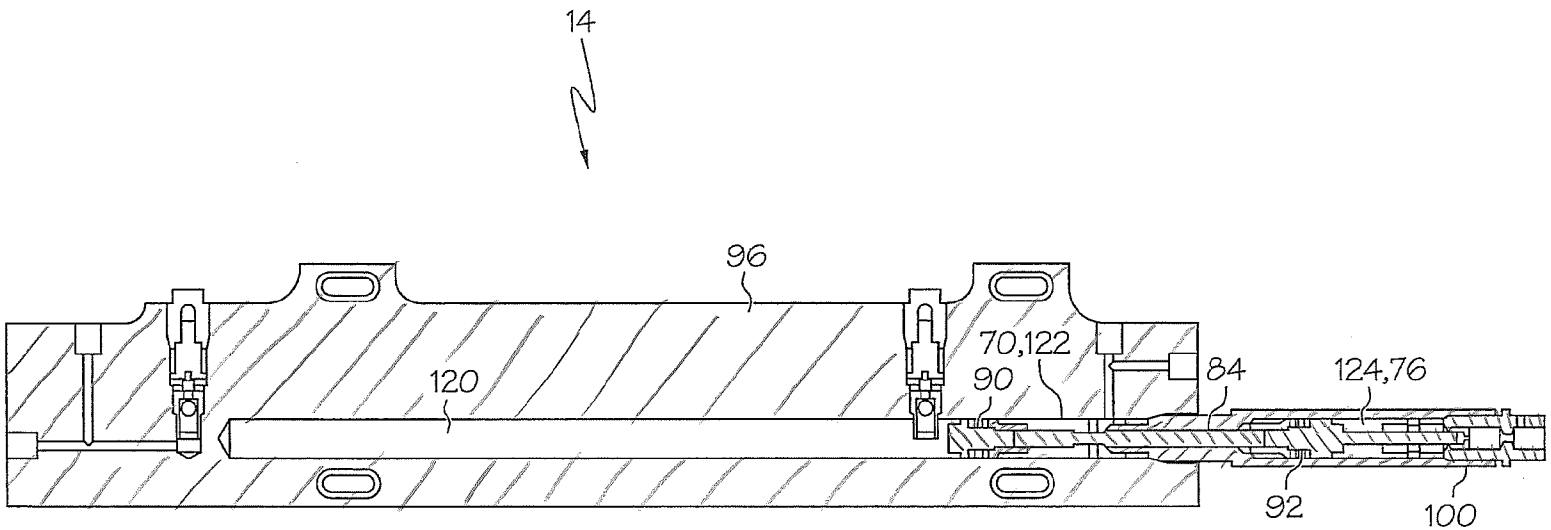
FIG. 6 depicts a portion of a control arrangement used in the subsurface safety valve of FIG. 1.
Figure 7:
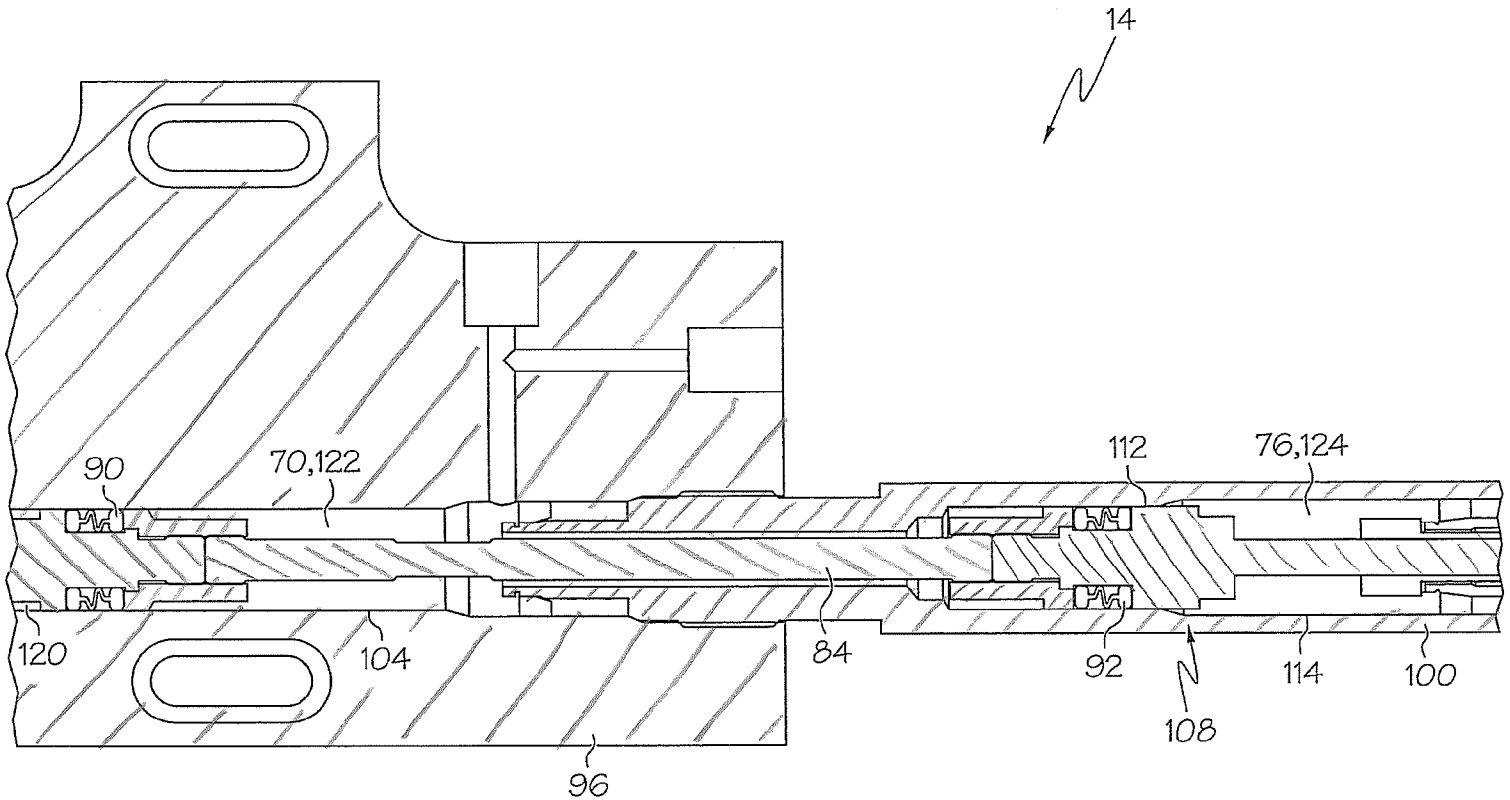
FIG. 7 depicts a portion of the control arrangement of FIG. 6 shown at a higher magnification.

Referring to FIGS. 6 and 7 a portion of the control arrangement 14 is illustrated in cross section at two different levels of magnification. The control arrangement 14 includes, a pressure-equalizing piston 84 with two seals 90, 92 thereon, a fill block 96 and a housing 100. The fill block 96 and the housing 100, which may both be made of metal, have cylindrical ports 104 and 108, respectively, formed therein that are receptive of the pressure-balancing piston 84. The housing 100 is sealably connected to the fill block 96 with the cylindrical ports 104, 108 in axial alignment with one another. The seals 90, 92 are in sealing engagement with the piston 84 and are in slidable sealing engagement with the cylindrical ports 104, 108 such that the piston 84 and seals 90, 92 can move axially within the cylindrical ports 104, 108 while maintaining sealing engagement with both the piston 84 and the ports 104, 108. The cylindrical port 108, however, has two portions 112, 114, the first portion 112 is dimensionally smaller than the second portion 114, and as such the seal 92 is sealably engagable with the first portion 112 while not being sealably engagable with the second portion 114. The second portion 114 is displaced axially from the first portion 112 such that axial movement of the piston 84 such that the seal 92 moves from the first portion 112 to the second portion 114 will result in a loss of seal between the seal 92 and the cylindrical port 108.

The seals 90, 92 divide the cylindrical ports 104, 108 into three cavities 120, 122, and 124. The seal 90 isolates the cavity 120 from the cavity 122, and the seal 92 isolates the cavity 122 from the cavity 124 when the seal 92 is in sealing engagement with the first portion 112. The cavity 122 is fluidically connected through porting not shown to the control line, which is also fluidically connected to cavity 70 of FIGS. 3-5. Similarly, cavity 124 is fluidically connected to the cavity 76 of FIGS. 3-5 through porting not shown. Cavities 124 and 76 are further fluidically connected to a pressurized gas charged primary reservoir or chamber not shown. Similarly, the cavity 120 is fluidically connected to a pressurized gas charged secondary reservoir or chamber, depicted herein as the cavity 120 in the fill block 96.

The foregoing structure is in accord with the failsafe control system of '351. As such failure of any of the seals 60, 62, 64, 90, and 92 will result in a pressure differential across the pressure-equalizing piston 84 so that it moves the seal 92 from sealing engagement with the first portion 112 to non-sealing engagement with the second portion 114. At this point the higher pressure of the pressurized gas charged primary reservoir (the cavities 124 and 76) is able to bleed to the control line (the cavities 122 and 70) thereby equalizing pressure between the pressurized gas charged primary reservoir and the control line. After which, the cavities 124, 76, 122 and 70 all have the same pressure therein. Once the pressure in cavities 124, 76, 122 and 70 is equalized the urging force of the power spring 26, which is set high enough to overcome the frictional and gravitational forces acting against it, is able to move the flow tube 18 to its uphole, or failsafe position, allowing the flapper 22 to close thereby preventing undesirable uphole fluid flow. Additionally, with the pressure-equalizing piston 84 no longer isolating the (control line) cavity 122, 70 from the cavity 124, 76, any increase in pressure in the control line will equalize about the actuating piston 42 preventing subsequent actuations of the safety valve 10 with increases in pressure in the control line. It should be that while the embodiment disclosed herein uses gas charged chambers to create biasing forces on the pistons 42, 84, alternate embodiments could create biasing forces using other sources of stored energy than chambers filled with a gas charge.

Figure 8:
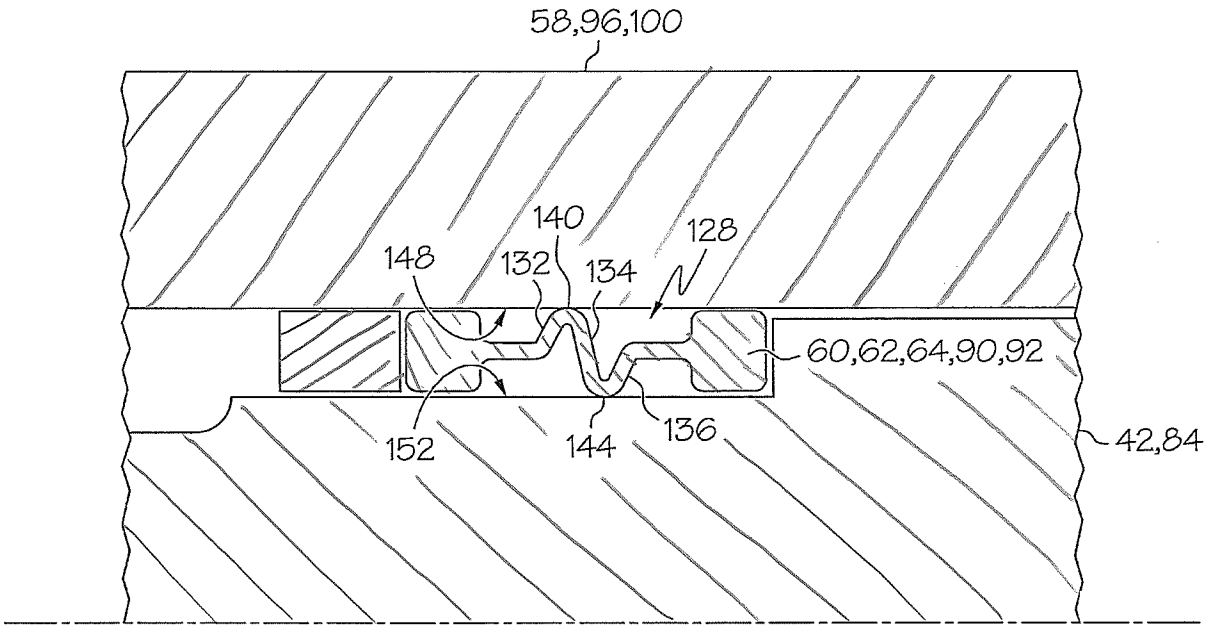
FIG. 8 depicts a metallic seal disclosed herein in assembly.

Referring to FIG. 8 an embodiment of the seals 60, 62, 64, 90, and 92 disclosed herein is illustrated. Each of the seals 60, 62, 64, 90, and 92 is made of a metal tubular member 128. The tubular member 128 includes three frustoconical portions 132, 134, and 136. The first frustoconical portion 132 and the second frustoconical portion 134 increase the radial dimension of the tubular member 128 to a greatest radial dimension portion 140 that has a greater radial dimension than all other portions of the tubular member 128 when in a non-energized position. Similarly, the second frustoconical portion 134 and a third frustoconical portion 136 decrease the radial dimension of the tubular member 128 to a smallest radial dimension portion 144 that has a smaller radial dimension than all other portions of the tubular member 128 when in a non-energized position. The seal 60, 62, 64, 90, and 92 is in a non-energized position (not shown) when the seal 60, 62, 64, 90, and 92 is not in an assembly and is therefore not constrained in any way. In the energized position (as shown in FIG. 8), the seal 60, 62, 64, 90, and 92 is constrained by an inner dimension and an outer dimension by a cavity into which it is assembled. As such, the tubular member 128 has a maximum radial dimension of the portion 140 that is greater when the tubular member 128 is in the non-energized position than the portion 140 has when it is in the energized position. Similarly, the tubular member 128 has a minimum radial dimension of the portion 144 that is smaller when the tubular member 128 is in the non-energized position than the portion 144 has when it is in the energized position.

The tubular member 128, therefore, is in the energized position when the portions 140, 144 are constrained within an assembly. In the energized position the portion 140 is sealably engagable with an inside sealing surface 148 of the housing 58, the fill block 96 or the housing 100, depending upon which seal 60, 62, 64, 90, and 92 is being used. A sealing force between the portion 140 and the inside sealing surface 148 is due to the energizing force of the tubular member 128 being in the energized position. This energizing force results from the elasticity of the metal from which the tubular member 128 is fabricated. Similarly, in the energized position the tubular member 128 has the portion 144 sealably engaged with an outside sealing surface 152 of the actuating piston 42 or the pressure-equalizing piston 84. A sealing force between the portion 144 and the outside sealing surface 152 is due to the energizing force of the tubular member 128 being in the energized position. This energizing force results from the elasticity of the metal from which the tubular member 128 is fabricated.

The elasticity of the metal tubular member 128 is such that the seal created between the tubular member 128 and the sealing surface 148, 152 is flexible enough to allow for minor movements of the pistons 42, 84 relative to the housings 58, 96, 100 without resulting in leakage therebetween. Additionally, the pistons 42, 84 and the tubular members 128 are axially slidably movable within the housings 58, 96, 100 while maintaining sealing engagement therebetween. The metal of the tubular member 128 can be highly resistant to degradation with long term exposure to high temperatures and high pressures that are commonly found in downhole environments. The metal of the tubular member 128 can also be highly resistant to corrosion and caustic fluids that may be encountered downhole as well. As such the sliding seal created between the seals 60, 62, 64, 90, and 92 and the housings 58, 96, 100, can have a high level of reliability and durability in very challenging applications.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims.

What is claimed is:

1. A biased actuator comprising:

a reservoir;

at least one piston in operable communication with the reservoir;

at least one metal seal disposed about the at least one piston and in substantial sealing communication therewith in response to a force of the at least one metal seal generated by resiliency of a metal from which the metal seal is fabricated when a minimum radial dimension formed by a first frustoconical portion and a second frustoconical portion of the at least one metal seal is dimensionally constrained by the at least one piston in response to contact between the minimum radial dimension and the at least one piston, the at least one metal seal further being in substantial sealing communication with the reservoir in response to a force of the at least one metal seal generated by resiliency of a metal from which the metal seal is fabricated when a maximum radial dimension formed by the second frustoconical portion and a third frustoconical portion of the at least one metal seal is dimensionally constrained by the reservoir in response to contact between the maximum radial dimension and the reservoir, the at least one metal seal remaining in sealing communication with both the piston and the reservoir during axial movement of the piston relative to the reservoir; and a biasing system in operable communication with both the reservoir and the at least one piston.

2. The biased actuator of claim 1, wherein the biasing system comprises a gas charge within the reservoir.

3. The biased actuator of claim 1, wherein the substantial sealing communication between the at least one metal seal and the piston is a metal-to-metal seal.

4. The biased actuator of claim 1, wherein the actuator is a part of a control arrangement for a downhole valve.

5. The biased actuator of claim 4, wherein the control arrangement includes a primary and a secondary biasing arrangement.

6. The biased actuator of claim 5, wherein, the primary biasing arrangement comprises a gas charge, the gas charge biasing arrangement being receptive to a gas charge calculated to balance a hydrostatic head at a planned depth of use of the downhole valve.

* * * * *